US006327371B1

(12) United States Patent
Proni

(10) Patent No.: US 6,327,371 B1
(45) **Date of Patent: *Dec. 4, 2001**

(54) LOUDSPEAKER WITH COOLING ADAPTER

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,661

(22) Filed: May 9, 2000

Related U.S. Application Data

(63) Continuation-in-part of application No. 08/964,095, filed on Nov. 4, 1997, now Pat. No. 6,118,884, which is a continuation of application No. 08/580,764, filed on Dec. 29, 1995, now Pat. No. 5,734,734.

(51) Int. Cl.[7] ..... H04R 1/00
(52) U.S. Cl. ..... 381/397; 381/403; 381/407
(58) Field of Search ..... 381/396, 397, 381/400, 403, 404, 407, 412, 420, FOR 154, FOR 159

(56) References Cited

U.S. PATENT DOCUMENTS

| | | | |
|---|---|---|---|
| 2,429,470 | 10/1947 | Knowles | 179/115.5 |
| 3,991,286 | 11/1976 | Henricksen | 179/115.5 |
| 4,327,257 | 4/1982 | Schwartz | 179/115.5 |
| 4,547,632 | 10/1985 | Bryson | 179/115.5 |
| 4,821,331 | 4/1989 | Murayama et al. | 381/192 |
| 4,933,975 | 6/1990 | Button | 381/192 |
| 5,042,072 | 8/1991 | Button | 381/192 |
| 5,081,684 | 1/1992 | House | 381/199 |
| 5,303,209 | 4/1994 | Frasl | 367/174 |
| 5,357,586 | 10/1994 | Nordschow | 381/199 |
| 5,497,428 | 3/1996 | Rojas | 381/199 |
| 5,625,701 | 4/1997 | Scanlan | 381/197 |
| 5,734,734 * | 3/1998 | Proni | 381/403 |
| 5,909,015 | 6/1999 | Yamamoto et al. | 181/156 |
| 5,940,522 | 8/1999 | Cahill et al. | 381/397 |
| 6,088,466 * | 7/2000 | Proni | 381/397 |
| 6,118,884 * | 9/2000 | Proni | 381/403 |

FOREIGN PATENT DOCUMENTS

| | | |
|---|---|---|
| 2667212 | 3/1992 | (FR) . |
| 3-220897 (A) | 9/1991 | (JP) . |
| 3-239099 (A) | 10/1991 | (JP) . |

* cited by examiner

*Primary Examiner*—Huyen Le
(74) *Attorney, Agent, or Firm*—Holland & Knight LLP

(57) ABSTRACT

A loudspeaker comprising a frame, a motor structure, an upper suspension, a lower suspension, a diaphragm, and, a voice coil carrying a wire winding and being formed with a number of circumferentially spaced vent bores spaced from the winding. An adaptor is provided having a wall with a first end mounted to the former of the voice coil, a second end, and an intermediate portion extending between the first and second ends which overlies the vent bores of the former and is radially offset thus forming a passage between the wall of the adaptor and a portion of the outer surface of the former. A ledge is formed at the second end of the adaptor wall for mounting the free ends of the diaphragm and lower suspension, which, in turn, position the voice coil within the magnetic gap in the motor structure.

5 Claims, 6 Drawing Sheets

LOUDSPEAKER WITH COOLING ADAPTER

This is a continuation-in-part of application Ser. No. 08/964,095, Filing Date Nov. 4, 1997 Now U.S. Pat. No. 6,118,884 which is a continuation of application Ser. No. 08/580,764, Filing Date of Dec. 29,1995 now U.S. Patent No. 5,734,734.

FIELD OF THE INVENTION

The present invention relates to loudspeakers, and in particular, to loudspeakers which incorporate an adaptor affixed to the voice coil of the speaker which aids in centering the voice coil throughout axial excursion during operation and assists with cooling of the wire winding of the voice coil in the course of venting air from the speaker.

BACKGROUND OF THE INVENTION

With reference to FIG. 1, a conventional loudspeaker 20 generally comprises a support frame 22, a cone 24, a dust cap 26 bridging across the cone, a suspension system, a voice coil 40, a voice coil former 43, and a vented pole piece 41. The voice coil 40 is wound about the voice coil former 43 such that an annular magnetic gap is defined between a top plate 37 and the magnet and the voice coil 40.

The magnetic circuit linearly cycles or displaces the voice coil former 43 in this gap. In the conventional speaker the cone 24 is attached to the voice coil former above the coil 40 at its lower end and to the frame at its upper end. A suspension system comprising two elements connects to the frame and upper end of the cone, and to the frame and voice coil former, respectively.

The suspension system of the loudspeaker normally comprises two elements, the surround 28 (upper or outer suspension) and the spider 38 (lower or inner suspension). The surround 28 is a mechanical device which holds the outer edge of the diaphragm/cone of the loudspeaker. The surround 28 functions to center the cone 24, and to provide a portion of the restoring force that keeps voice coil in the gap defined between the pole piece and the top plate of the loudspeaker. The spider 38 also helps to keep the voice coil concentric to the pole piece, and it provides another component of the restoring force that maintains the voice coil within the gap.

Often a loudspeaker design can be best optimized by utilizing a voice coil with a smaller diameter. However, the smaller voice coil setup creates certain problems, especially when designing loudspeakers for low frequency reproduction. Thus, for larger diameter loudspeakers (typically 10 inches and above), small voice coil systems are not common. Accordingly, there are few, if any, existing cones tooled for the smaller diameter coil former. To incorporate a small voice coil system, the cone must be customized, adapted or re-tooled.

One disadvantage of mating a cone directly to a smaller voice coil is that a relatively small adhesive joint is made. Since the voice coil's diameter is much smaller, the gluing circumference is drastically reduced. Therefore, the designer must be concerned with the possibility of mechanical failures since the stress distribution around the glue joint is high. Because the spider attaches at this critical junction as well, spider joint stress also increases, introducing yet another possible failure mode.

Another problem associated with smaller voice coils occurs in the use of pole vents. Pole vents comprise holes bored directly through the pole piece within the motor structure. These vents are used to relieve air pressure that builds up beneath the dust cap. Without a pole vent, audible noise can be introduced as the trapped air tries to escape during large cone excursions. However, when using a small diameter voice coil, the amount of metal in the pole piece is very limited. This amount of steel can only support limited amount of magnetic flux. Consequently, using a pole piece with large amounts of metal removed for pole vents can radically alter the performance of the magnetic circuit.

A vented pole piece further effects the thermal behavior of the speaker. The steel contained in the pole piece provides an effective thermal sink for the voice coil. Machining a pole vent in the pole piece increases thermal resistance of the sink, lowering the power handling capability of the loudspeaker.

The mechanical integrity of the spider is also comprised when using small voice coil. Spiders are typically made from resin treated cloth materials. When the inner diameter of the spider gets smaller, fewer strands of material intersect the cutout. Since the glue joint lies on this small circumference, very little spider material is captured. This places the spider material under greater stress than normal. This high-stress condition could cause the spider itself to fatigue prematurely. Since the spider is typically called on to center the moving assembly and limit cone motion at the extremes of excursion, a comprised spider could cause a catastrophic failure.

Resistance to rocking is reduced when using a smaller inner diameter voice coil. The term "rocking" refers to tilting of the voice coil toward the pole piece and/or top plate within the gap between the two. As a spider's inner diameter gets larger, the material along the inner diameter is required to deflect more when the moving assembly rotates a given amount (as during rocking). Consequently, a spider with a larger inner diameter will be more resistant to rocking because more energy is required to invoke a given angular change. It follows that using a small voice coil, and hence a small inner diameter spider, makes a given loudspeaker more susceptible to rocking related problems.

The smaller voice coil system further affects the cone's structural integrity. As a voice coil gets smaller, the cone angle increases (using a vertical axis as a reference), causing the cone to become flatter. As the cone begins to flatten, its mechanical strength drops. Increasing the cone angle increases the likelihood of audible degradation due to cone flexure. Normally, the only option available for preventing cone flexure is to increase the cone thickness and/or increase the cone depth. This decreases the cone angle and makes the cone wall more vertical. These solutions, however, are not desirable since increasing the cone depth requires a larger frame depth and using a thicker cone adds weight to the moving structure. Moreover, thicker cones and deeper frames require special tooling and make the speaker's mounting depth unattractive for certain applications.

Several loudspeaker designs are contemplated in the background art for improving speaker performance, stabilizing the speaker cone/diaphragm, and/or simplifying the manufacturing process. However, none of these references solve the above-noted problems. For example, Mitobe (U.S. Pat. No. 5,111,510) discloses a speaker and manufacturing method therefor including a diaphragm integrally combined with a first frame piece and a driver unit integrally combined with a second frame piece. Saiki et al. (U.S. Pat. No. 5,371,805) discloses a speaker and speaker system employing the same, comprising a diaphragm secured to a first periphery of an edge member and a frame secured to a second periphery of the edge member. Scholz (U.S. Pat. No. 5,323,469) discloses a conical loudspeaker having a conical stabilizing element joined between an underside of a speaker membrane and an outside surface of a speaker moving coil carrier. Kreitmeier (U.S. Pat. No. 5,424,496) discloses an electromagnetic converter comprising an internal magnet system, a moving coil and tubular segment. Kreitmeier (U.S. Pat. No. 4,764,968) discloses a disk-like diaphragm made from a conical plastic film and provided with vacuum formed support members which extend up to the disk-like radiating layer. Finally, Kobayashi (U.S. Pat. No. 4,118,605) discloses a coil mount structure comprising a cylindrical member, around one end portion of which a diaphragm edge is fixed, an inner peripheral edge portion where a damper is removably fixed, and an opposite end portion around which a coil is provided. Kobayashi, however, does not provide any structure for ventilating air pressure from beneath the dust cap or a structure for creating a secure joint between the diaphragm/cone, spider, and/or voice coil. The present invention, by way of contrast, is directed to an adaptor ring, the structure of which facilitates a stronger adhesive joint between the cone, spider, and voice coil bobbin or former, and means for venting air pressure buildup.

The above-noted background art neither solves or addresses the problems contemplated by the present invention. Accordingly, there remains a need for a loudspeaker capable of providing improved structural joints between the speaker cone, spider, and voice coil former, allowing the use of smaller voice coil systems and providing ventilation in the speaker without forfeiting performance.

SUMMARY OF THE INVENTION

It is therefore among the objectives of this invention to provide a loudspeaker which reduces rocking motion of the voice coil during excursions, which improves the connections between the diaphragm, lower suspension and voice coil, which provides adequate venting of the area overlying the voice coil and which assists with cooling of the voice coil.

These objectives are accomplished in a loudspeaker comprising a frame, a motor structure, an upper suspension, a lower suspension, a diaphragm, and, a voice coil carrying a wire winding and being formed with a number of circumferentially spaced vent bores spaced from the winding. An adaptor is provided having a wall within a first end mounted to the former of the voice coil, a second end, and an intermediate portion excluding between the first and second ends which overlies the vent bores of the former and is radially offset thus forming a passage between the wall of the adaptor and a portion of the outer surface of the former. A ledge is formed at the second end of the adaptor wall for mounting the free ends of the diaphragm and lower suspension, which, in turn, position the voice coil within the magnetic gap in the motor structure.

This invention is predicated upon the concept of providing an additional structural element connected to the voice coil of a loudspeaker which provides the combined advantages of improving the attachment of the diaphragm and lower suspension to the voice coil, venting of air from the area overlying the voice coil, and, in one presently preferred embodiment, providing at least some cooling of the wire winding on the former of the voice coil.

In one group of embodiments described below, the wall of the adaptor has an inner surface, an outer surface and a number of vent bores extending between the inner and outer surfaces. The former is mounted within and secured along the entire length of the inner surface of the adaptor ring at a location spaced from the wire winding. In an alternative embodiment, as noted above, one end of the wall of the adaptor is attached to the former, and an intermediate portion of the adaptor wall is radially offset to form a passage between the adaptor ring wall and the exterior surface of the former. In either embodiment, the adaptor is effective to vent the cavity formed by the dust cap or diaphragm which overlies the voice coil. A flow of air into and out of such cavity is obtained either through the vent bores formed in the adaptor itself, or through the passage formed between the wall of the adaptor and the former. Additionally, both embodiments of the adaptor ring include a ledge for mounting one end of each of the diaphragm and lower suspension to minimize the chance of a failure of the adhesive bond at that location.

In the embodiment of the adaptor having a wall with a radially offset intermediate portion, it is preferable that such intermediate portion extend from the area of the vent bores in the former to a location proximate the wire winding. The objective in this embodiment is to not only vent the dust cap cavity, but to direct the flow of air moving into and out of such cavity via the passage formed between the adaptor wall and former along at least a portion of the wire winding. This provides the advantage of some cooling of the wire winding, in addition to venting.

DETAILED DESCRIPTION OF THE PREFERRED EMBODIMENTS

With reference to the drawings, FIGS. 2–9 depict the preferred embodiment of the voice coil adaptor ring 51 and loudspeaker system 50 incorporating the adaptor ring 51 in accord with the preferred embodiment of the instant invention. The loudspeaker 50 of the instant invention incorporates the voice coil adaptor ring 51 and comprises a cone-shaped diaphragm 24' (cone), a frame 22' supporting the upper end of the cone 24', a voice coil 40' wound around a voice coil former 43', the voice coil adaptor ring 51 mounted over the former 43', an upper suspension 28', a spider 38' and a magnetic circuit. The spider 38' is attached to the adaptor ring 51 to provide a centering force for the former 43' and voice coil 40'. The magnetic circuit comprises at least one magnet 35', a pole piece 41', a front plate 37' and a back plate 33'. A magnetic gap exists between the top plate 37' and the pole piece 41. Together, the adaptor ring 51 and spider suspension center the voice coil system and former in this gap.

Figure 4:
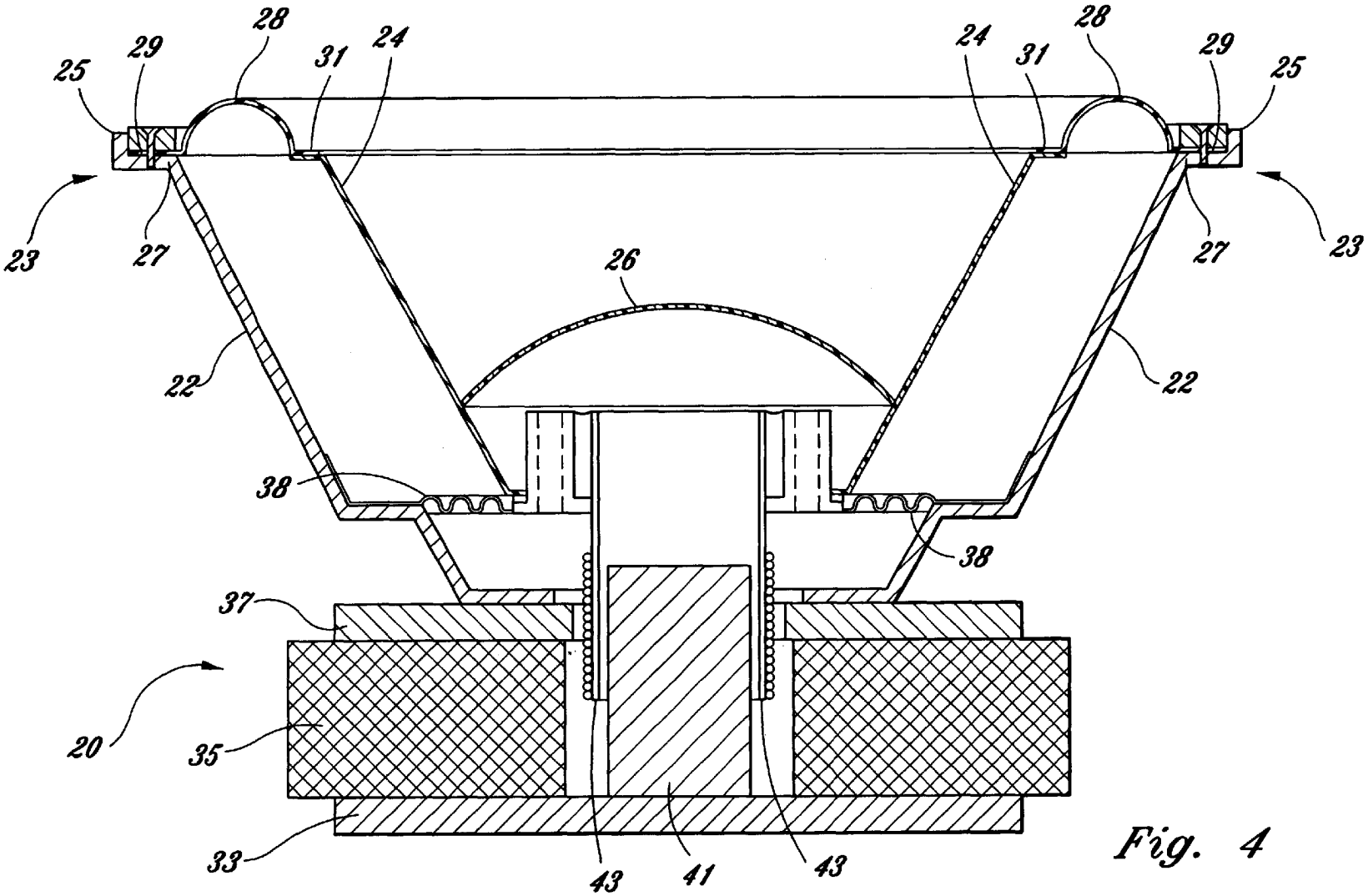
FIG. 4 is a cross-sectional view of the preferred embodiment of the loudspeaker and voice coil adaptor ring of the instant invention, as installed in the loudspeaker.
Figure 5:
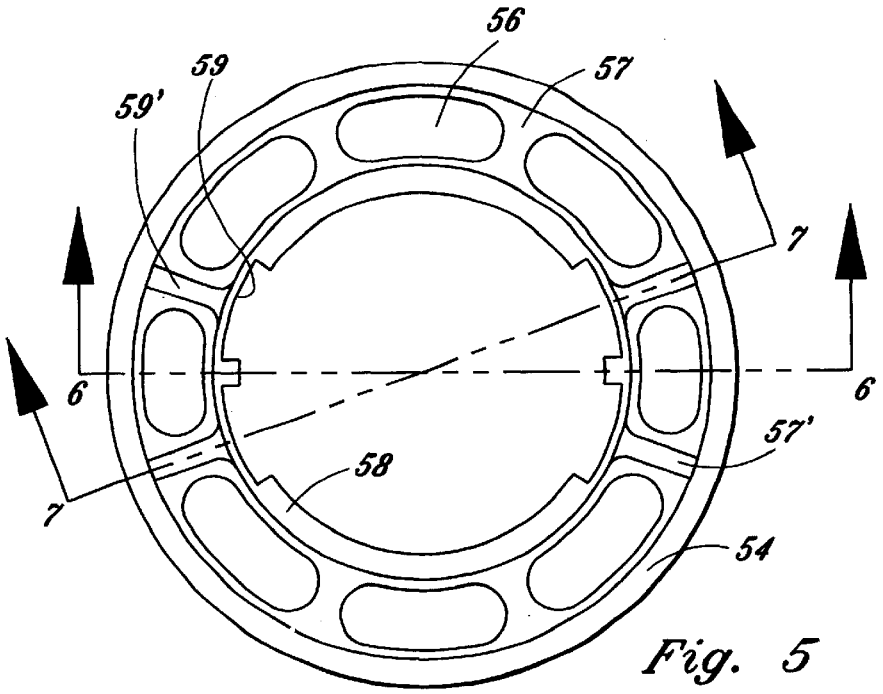
FIG. 5 is a top planar view of the voice coil adaptor ring of the instant invention.
Figure 9:
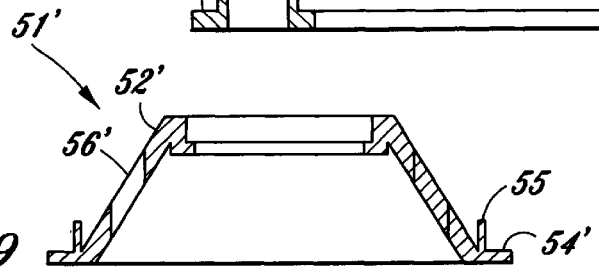
FIG. 9 is a cross-section view of another embodiment of the adaptor ring of the instant invention.

The voice coil adaptor ring 51 comprises a sleeve having substantially cylindrical walls 52 adapted for snugly mating and conforming to the outer peripheral edges of the voice coil former 43'. With reference to FIG. 9, the adaptor ring in the alternative may comprise other shapes, such as conical, without departing from the scope and spirit of the instant invention. As seen in FIG. 4, the adaptor ring 51 defines a first inner diameter D1 which corresponds to the diameter/dimensions of the voice coil former 43'. The first inner diameter D1 of the adaptor ring 51 is defined by an inner glue flange 58. A second inner diameter D2, larger than the first, is defined by the interior of wall 52*a* and the exterior wall of voice coil former 43' when the ring 51 is installed. This gap is filled with epoxy 60 to secure the adaptor ring 51 to the voice coil former 43'.

In the alternative, the former 43' may be manufactured with a projecting shelf on which the adaptor ring would sit and lock in place. In this alternative embodiment, the inner glue flange 58 would define grooves 59 which would interlock with the projecting shelf where the adaptor ring is rotated, locking it in place.

The adaptor ring 51 further comprises venting passages 56 which are bored vertically through the cylindrical walls 52 to provide a complete passageway for venting air from the dust cap volume of the speaker. The dust cap volume is defined by the cone walls 24' and dust cap 26'. The venting passages 56 prevent pressure build up in this volume for improved sound quality. In the preferred embodiment, an annular gap or pocket is defined by the adaptor rings walls 52, inner glue flange 58, and voice coil former 43' for filling with epoxy 60. This adheres the ring 51 to the former 43'.

Figure 6:
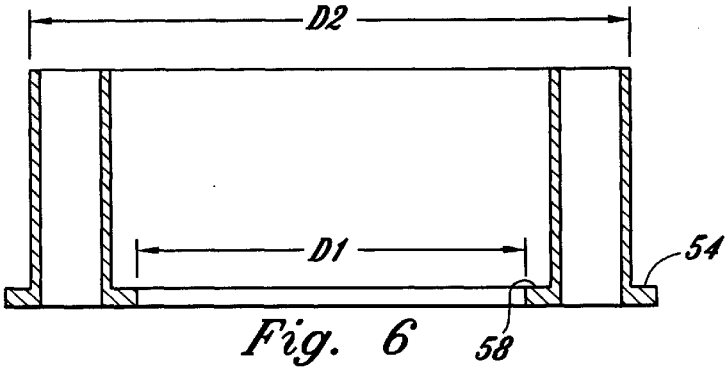
FIG. 6 is a cross-sectional view of an embodiment of the voice coil adaptor ring taken along line 6—6 of FIG. 5.
Figure 7:
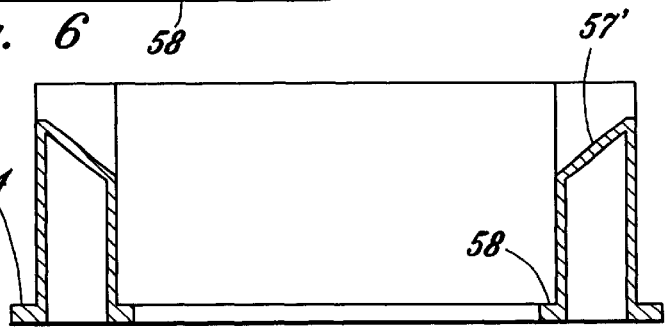
FIG. 7 is a cross-sectional view of an embodiment of the voice coil adaptor ring taken along line 7—7 of FIG. 5.

With reference to FIGS. 6–7, a cross section of the adaptor ring is shown to illustrate the venting passages 56 and the inner glue flange 58. The passages 56 are divided by partitions 57. The partitions 57 may be sloped, tapered, planar or otherwise. Selected partitions 57' may be sloped, as shown in FIG. 7 to reduce stress on lead out wires when they are run through the adaptor 51. Lead out wires are typically fragile, so bending the wires at right angles would increase the risk of fractures. Referring to FIGS. 2–7, the adaptor ring 51 includes a means for running lead out wires. This wire running means preferably comprises slots 59' defined at selected locations around the inner peripheral edge of the inner glue flange 58 so that wire running channels are formed when the adaptor ring 51 is mounted to the voice coil former 43'. The slots 59' should be in alignment with the sloped partitions 57' so that lead out wires may be passed through the wire channels and over the sloped partitions. In the alternative, wire channels may be bored through the adaptor ring walls 52, plateau 54 or inner glue flange 58. The adaptor ring 51 may be manufactured by any plastic, thermoplastic, polymer plastic, metal or other acceptable material. An injection molding process is preferred to make the ring 51. It should be noted, however, that any embodiment of the adaptor ring may be manufactured integrally with the voice coil former 43' such that the adaptor ring would be metallic. At least one wire channel 55 may also be provided by the ring 51 for running wires.

Figure 1:
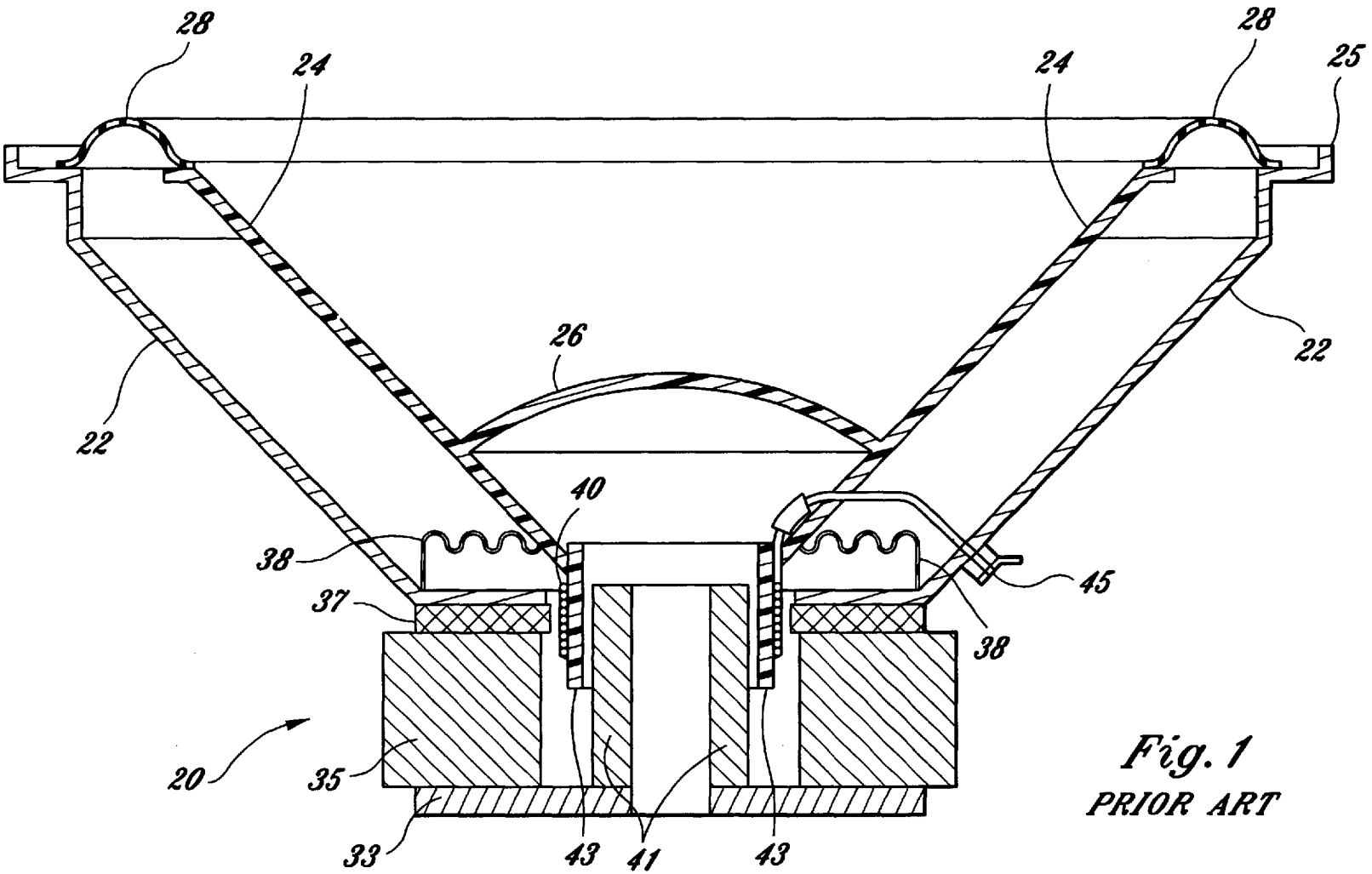
Fig. 1 PRIOR ART
FIG. 1 is a cross-sectional view of a prior art loudspeaker.
Figure 1A:
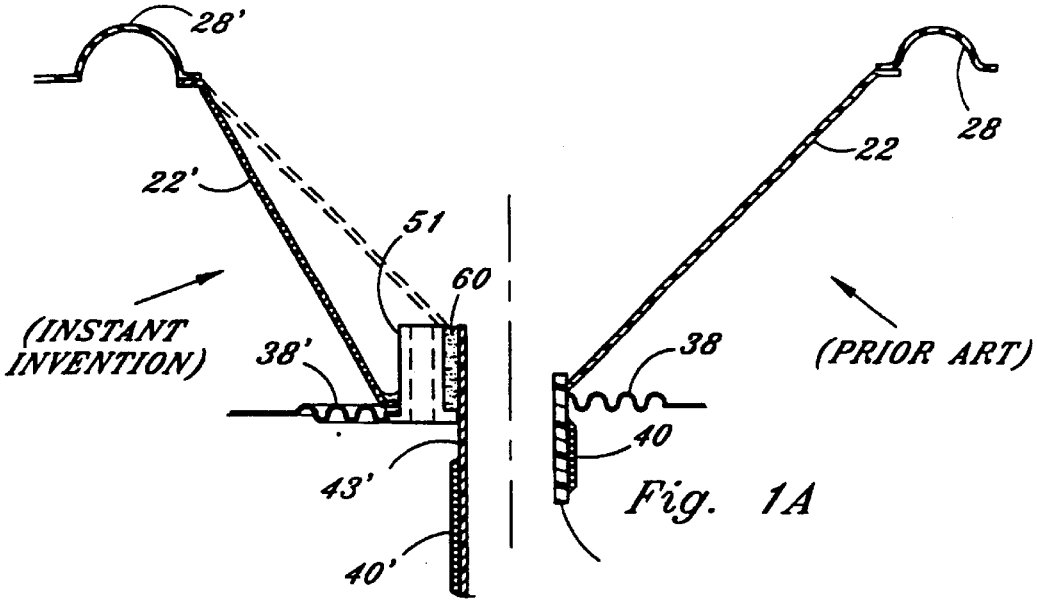
FIG. 1A is an illustration of the cone angle increase when incorporating the instant invention.
Figure 2:
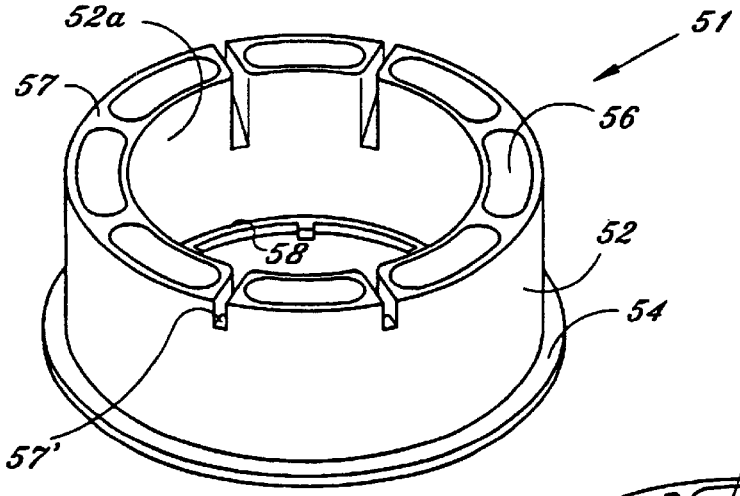
FIG. 2 is a top perspective view of the preferred embodiment of the voice coil adaptor of the instant invention.
Figure 3:
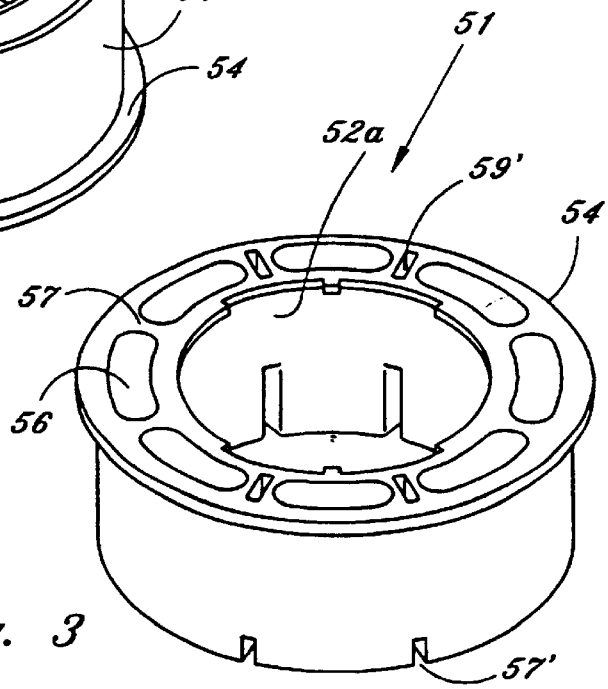
FIG. 3 is a bottom perspective view of the voice coil adaptor of the instant invention.

The venting passages 56 eliminate the need for a pole vent 42, as shown in FIG. 1. The conventional pole vent 42 is required in the background art to vent heat and air pressure build up in the cap volume, as defined by the dust cap 26 and the cone 24. The voice coil adaptor ring 51 of the instant invention eliminates the pole vent 42 by including venting passages 56 in the adaptor ring 51, as discussed above. The venting passages 56 comprise channels bored completely through the cylindrical wall 52 from the top end to the bottom end. Replacing the conventional pole vent 42 with the adaptor ring vent passages 56 saves machining in the pole piece structure 41 so as to reduce costs. A solid pole piece 41 also increases magnetic circuit efficiency and provides an improved thermal path for heat transfer from the voice coil. By allowing for improved heat transfer from the voice coil, the driver may be operated at a higher power rating.

With reference to FIGS. 2–8, the adaptor ring 51 of the instant invention preferably has cylindrical walls 52 that define an exterior spider plateau 54. The spider plateau 54 is preferably planar, or substantially horizontal, such that it provides a ledge for receiving and securing the spider/lower suspension 38' and the neck/lower edge of the speaker cone 24'. The spider plateau 54 preferably supports the inner edge of the spider 38' and provides enough surface area for applying adhesives between the spider 38' and the ledge 54 so as to firmly secure the spider in place. Adhesives are also applied to the upper surface of the spider 38' for adhering the neck of the cone 24'. The instant invention is superior to the background art, whereby the ledge 54 of the adaptor ring 51 provides a more stable securing structure than the vertical surface of the voice coil former 43'. In addition, it provides a structure that enables the joining of the cone 22' and spider 38' for a stronger joint. Accordingly, attaching the spider 38' and cone 24' to the voice coil adaptor ring 51 along a larger circumferential planar surface provides more contact area for applying epoxy. This additional contact area alleviates stress on the glue joints via improved stress distribution for increased reliability. In the alternative, the surface of the spider plateau 54 and/or the entire adaptor ring 51, can be textured or ribbed to enhance adhesion. The adaptor ring 51 and spider plateau 54 also provide a mechanical stop for the cone's 24' lower edge providing a more reliable joint. Once the cone 24' is attached to the top of the spider 38', the spider 38' is completely locked in place. Consequently, the spider/cone/voice coil joint is virtually eliminated as a possible point of failure in the loudspeaker.

Referring to FIG. 4, the voice coil adaptor ring 51 provides extra coil attachment height allowing a larger adhesive contact area, especially in small diameter voice coils. In addition, the inner glue flange 58, aids in the gluing process by catching and holding the glue in contact with the coil former surface allowing for a larger amount of adhesive to be used. This large joint provides a more favorable stress distribution around the coil former 43' making the attachment more reliable.

The voice coil adaptor 51 facilitates use of a corrugated spider 38' having a larger inner diameter in the area of its mid section. A spider with a large inner diameter is amenable with the instant invention because of the additional security provided by the voice coil adaptor ring 51 and spider plateau 54. That is, because more spider material is adjacent to the glue joint in a loudspeaker using the voice coil adaptor in 51, spider fatigue is less of a concern. As noted, a larger inner diameter spider 38' is more resistant to rocking that may incur in a loudspeaker. With the use of the adaptor ring 51, the acceptable spider material deflection is increased for a given degree of coil rotation making the spider more resistant to fatigue. The additional stability provided by the adaptor ring 51 and corrugated spider 38', make the speaker stronger and more reliable. The improved centering force allows for tightened tolerances in the magnetic gap as defined between the top plate 37' and pole piece for improved speaker performance. Maintaining a smaller magnetic gap increases the motor strength and enhances the thermal power handling of the loudspeaker.

The adaptor ring 51 moves the contact point of the lower cone edge outward. As a result, the cone angle is decreased, with reference to a vertical axis, for higher strength and rigidity. As a result, the cone 24' is not only more reliably stabilized, but may be manufactured from a thinner material reducing the cone's weight and audible coloration.

Figure 8:
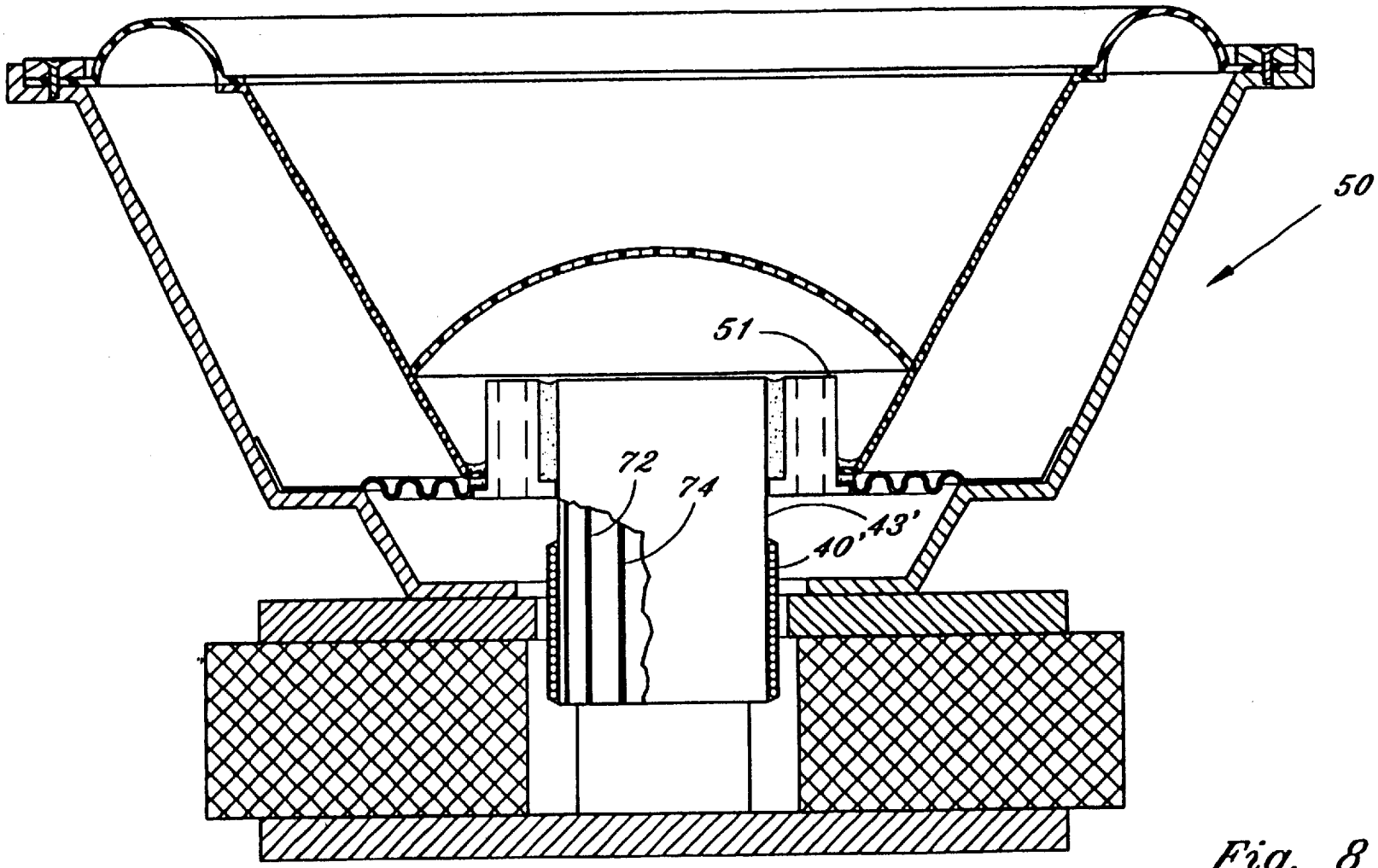
FIG. 8 is a cross-sectional view of another embodiment of the loudspeaker of the instant invention with a partial cutout in the voice coil former to illustrate grooves on the inner surface of the voice coil former when the former and adaptor ring assembly are manufactured from a conductive material.

With reference to FIG. 8, the voice coil former 43' may have grooves 72 and 74' formed along the interior wall, preferably from top to bottom. The grooves 72 and 74 provide a means and structure for breaking any conductive loop in the former 43' that may result. These grooves 72, 73 may be especially necessary when the adaptor ring is formed integrally with the former 43' and the former-adaptor ring assembly is electrically conductive. An alternative embodiment of the adaptor ring is shown in FIG. 9, where the adaptor is conical in shape. The conical adaptor 51' performs the same functions as the preferred adaptor 51 and likewise comprises a spider plateau 54', a sloped wall 52', and vent passages 56'. A vertical stop 55 is also included in the alternative embodiment for receiving the cone and spider and facilitating an improved adhesion surface.

Figure 10:
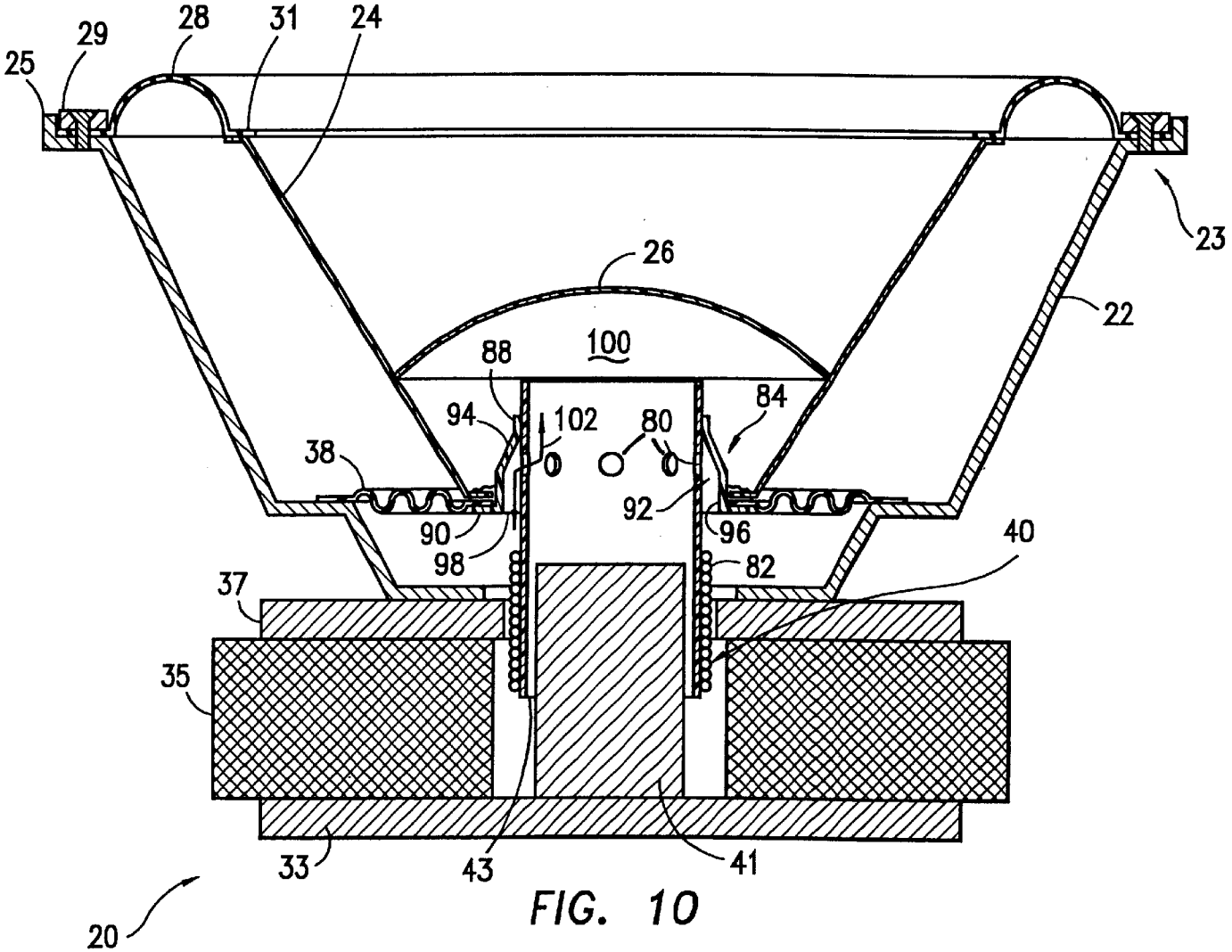
FIG. 10 is a cross-sectional view of a further embodiment of the adaptor ring herein.

Referring now to FIG. 10, a still further embodiment of the loudspeaker system 50 of this invention is depicted, and the same reference numbers used in the embodiments described above are employed in this embodiment to identify the same structure.

Unlike the previous embodiments, the former 43 of the voice coil 40 is formed with a number of circumferentially spaced vent bores 80 at a location vertically above and spaced from the wire winding 82 in the orientation of the loudspeaker 50 as shown in FIG. 10. The adaptor ring 84 of this embodiment includes a wall having an annular collar 88, a ledge 90 and an intermediate portion 92 extending between the collar 88 and ledge 90. The intermediate portion 92 comprises a tapered section 94 extending radially outwardly at an angle from the collar 88, and a vertical leg 96 connected between the tapered section 94 and ledge 90. The annular collar 88 of the adaptor ring 84 is mounted to the outer surface of the former 43 by adhesive or the like in position so that the intermediate portion 92 overlies the vent bores 80 in the former 43. Because the tapered section 94 extends outwardly from the collar 88, the intermediate portion 92 of the adaptor ring 84 is radially offset from the wall of the former 43 thus forming a passage 98 therebetween. As in the previous embodiments, the ledge 90 receives a quantity of adhesive to secure one end of each of the lower suspension or spider 38 and the diaphragm or cone 24.

The operation of the loudspeaker system 50 of this embodiment is similar to that of the embodiments described above in connection with a discussion of FIGS. 2–9. One difference, however, is in the manner in which the dust cap cavity 100 between the dust cap 26 and voice coil 40 is vented. In the previous embodiments, venting is achieved through the passages formed in the wall of the adaptor rings 51 and no space or passage is provided between the former 43 and the adaptor rings 51, i.e., the inner wall of the adaptor rings 51 is cylindrical-shaped and mounted along its entire length to the outer surface of the former 43. In the embodiment of FIG. 10, the adaptor ring 84 is particularly designed to provide venting, and at least some cooling of the wire winding 82, in voice coils 40 of the type having a former 43 with integral vent bores 80. In the course of movement of air into and out of the dust cap cavity 100, air is caused to move along a flow path depicted by arrow 102 and defined, in part, by the vent bores 80 in the former 43 and the passage 98 between the intermediate portion 92 of the adaptor 84 and the former 43. The intermediate portion 92 deflects the air exiting the vent bores 80 and directs it along the passage 98 into engagement with at least a portion of the wire winding 82 of the voice coil 40. Outside, ambient air moves along that same flow path in the reverse direction when entering the dust cap cavity 100. Consequently, in addition to effectively venting the dust cap cavity 100, this construction of the adaptor 84 provides for at least some cooling of the wire winding 82 due to flow of air it directs into contact with such winding 82.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that he invention not be limited to the particular embodiment disclosed as the best mode contemplated for carrying out the invention, but that the invention will include all embodiments falling within the scope of the appended claims.

What is claimed is:

1. A loudspeaker, comprising a frame;

an upper suspension having one end connected to said frame, and an opposite end connected to a diaphragm;

a lower suspension having one end connected to said frame;

a motor structure including a top plate, a back plate, a magnet connected between said top plate and said back plate and a pole piece concentrically disposed within a bore collectively formed by said top plate and said magnet, a gap being formed between said pole piece and said top plate;

a voice coil including a former carrying a wire winding, said former being formed with a number of vent bores spaced from said wire winding;

an adaptor including a wall having a first end, a second end and an intermediate portion between said first and second ends, said first end of said wall being directly mounted to said former in position so that said intermediate portion extends along side said former in alignment with said vent bores therein, said intermediate portion of said wall being radially spaced from said former to form a passage therebetween;

each of said diaphragm and said lower suspension being connected to said wall of said adaptor which is interposed between said former and said lower suspension and diaphragm so that said voice coil is positioned for axial movement in said gap between said top plate and pole piece;

a cavity being formed in an area overlying said pole piece from which air is vented along a flow path which includes said vent bores in said former and said passage in between said intermediate portion of said wall of said adaptor and said former, said intermediate portion of said adaptor being located relative to said former so that air passing through said vent bores is deflected by said intermediate portion in a direction toward said wire winding of said voice coil.

2. The loudspeaker of claim 1 in which said first end of said wall of said adaptor includes an annular collar mounted to said former, said intermediate portion including a tapered section connected at one end to said annual collar and at an opposite end to a vertical leg.

3. The loudspeaker of claim 2 in which said second end of said wall of said adaptor includes a ledge extending radially outwardly from said vertical leg.

4. The loudspeaker of claim 3 in which said lower suspension is mounted to said ledge.

5. The loudspeaker of claim 3 in which said diaphragm is mounted to said ledge.

* * * * *